US006110026A

United States Patent [19]

Arai

[11] Patent Number: 6,110,026

[45] Date of Patent: Aug. 29, 2000

[54] CARRIER AND POLISHING APPARATUS

[75] Inventor: Hatsuyuki Arai, Ayase, Japan

[73] Assignee: SpeedFam Co., Ltd., Japan

[21] Appl. No.: 09/275,497

[22] Filed: Mar. 24, 1999

[30] Foreign Application Priority Data

Apr. 29, 1998 [JP] Japan ..... 10-134605
May 11, 1998 [JP] Japan ..... 10-145075

[51] Int. Cl.[7] ..... B24B 1/00

[52] U.S. Cl. ..... 451/289; 451/286

[58] Field of Search ..... 451/286–289, 451/398

[56] References Cited

U.S. PATENT DOCUMENTS

| | | | |
|---|---|---|---|
| 5,205,082 | 4/1993 | Shendon et al. . | |
| 5,398,459 | 3/1995 | Okumura et al. | 451/286 X |
| 5,423,716 | 6/1995 | Strasbaugh | 451/289 X |
| 5,584,746 | 12/1996 | Tanaka et al. | 451/289 X |
| 5,624,299 | 4/1997 | Shendon | 451/287 X |

FOREIGN PATENT DOCUMENTS

| | | |
|---|---|---|
| 2-243263 | 9/1990 | Japan . |
| 6-97618 | 3/1994 | Japan . |
| 7-112364 | 5/1995 | Japan . |

*Primary Examiner*—David A. Scherbel
*Assistant Examiner*—Anthony Ojini
*Attorney, Agent, or Firm*—Wall Marjama Bilinski & Burr

[57] ABSTRACT

A carrier and polishing apparatus enabling high precision polishing of a workpiece and enabling prevention of leak contamination and damage to the workpiece. A carrier 1 is provided with a carrier body 2, a pressure chamber 3, and a fluid passage portion 4 and a plurality of valve portions 5 are specially provided in the pressure chamber 3. Due to this, when the inside of the pressure chamber 3 becomes a negative pressure state, the valve portions 5 open and the wafer W is picked up by suction, while when it becomes a positive pressure state, the valve portions 5 close and the air in the pressure chamber 3 uniformly presses against the wafer W. Further, since the valve portions 5 close in the positive pressure state, the air in the pressure chamber 3 will not flow to the outside.

10 Claims, 14 Drawing Sheets

CARRIER AND POLISHING APPARATUS

BACKGROUND OF THE INVENTION

1. Field of the Invention

The present invention relates to a carrier and a polishing apparatus capable of picking up, pressing, and releasing a wafer or other workpiece.

2. Description of the Related Art

FIG. 17 is a sectional view of a carrier of the related art.

A carrier 100 is comprised of a housing 101, a carrier base 103 attached to the bottom surface of the housing 101 and having a backing sheet 102 at its bottom surface, and a retainer ring 104 attached to the outer periphery of the bottom surface of the carrier base 103.

The carrier 100 is further formed with a plurality of air holes 106 passing through the backing sheet 102 and carrier base 103 and communicating with grooves 105 of the housing 101 at their upper ends, and an air exit/inlet communicating with the grooves 105.

Due to this, the wafer W may be picked up by making the insides of the air holes 106 a negative pressure state. At the time of polishing, the negative pressure state inside the air holes 106 is released and the wafer W polished while pressing the wafer W by the carrier base 103 against a polishing pad 111 of a rotating platen 110. Further, by supplying water at a predetermined pressure into the air holes 106, the polished wafer W can be released from the backing sheet 102.

In this carrier 100, however, since the back surface of the wafer W (top surface in FIG. 17) is pressed by a hard carrier base 103, that is, the so-called back side reference system is adopted, it is not possible to obtain a desired precision when flattening the front surface of a wafer W (bottom surface in FIG. 17).

Therefore, as shown in FIG. 18, a carrier adopting a so-called front side reference system has been devised.

A carrier 300 provides a ring-shaped projecting portion 302 at the outer peripheral portion of the bottom surface of a carrier base 301. By adhering a film 305 having a plurality of holes 305*a* to the bottom surface of the projecting portion 302, a pressure chamber 303 is defined. A retainer ring 304 is adhered by a double-sided adhesive tape 308 at the outer peripheral portion of the bottom surface of the film 305, that is, to a position corresponding to the projecting portion 302.

Due to this configuration, it is possible to pick up the wafer W by placing the inside of the pressure chamber 303 in a negative pressure state and, at the time of polishing, to return the inside of the pressure chamber 303 to the positive pressure state and polish the wafer W while pressing the wafer W against the polishing pad 111 of the rotating platen 110 by the air in the pressure chamber 303 through the film 305. Further, it is possible to supply water at a predetermined pressure into the pressure chamber 303 to release the polished wafer W from the film 305.

The carrier 300 shown in FIG. 18, however, had the following problem:

With this carrier 300, the film 305 would deform to match the shape of the back surface of the wafer W. Further, the entire surface of the wafer W was pressed by a uniform air pressure. Therefore, it was possible to polish the surface of the wafer W to a high precision.

Since the air in the pressure chamber 303 escaped to the outside from the holes 305*a* in the film 305 and then along the upper surface of the wafer W, however, the wafer W was contaminated, i.e., so-called leak contamination occurred. Further, the polishing solution entering between the retainer ring 304 and the wafer W was dried by the air escaping from the holes 305*a* resulting in abrasive becoming affixed on the inner peripheral surface of the retainer ring 304. Therefore, clumps of abrasive could peel off during polishing and scratch the wafer W.

SUMMARY OF THE INVENTION

An object of the present invention is to provide a carrier and polishing apparatus which enables high precision polishing of a workpiece and enables prevention of leak contamination or damage to the workpiece.

To achieve this object, according to an aspect of the present invention, there is provided a carrier comprising: a carrier body having a workpiece holding hole; a pressure chamber defined by a pliable sheet laid in the holding hole of the carrier body and capable of contacting the entire back surface of a workpiece; a fluid passage portion formed by a fluid path provided in the carrier body and communicating with the pressure chamber and by a plurality of holes provided in the sheet and communicating with the pressure chamber; and valve portions provided near the holes of the sheets for closing the holes when the inside of the pressure chamber is a positive pressure in state and opening the holes when the pressure chamber is a negative pressure in state.

Due to this configuration, when the inside of the pressure chamber is made a negative pressure state in the state with the workpiece placed in contact with the sheet, the valve portions open, the insides of the plurality of holes of the fluid passage portion become negative pressure states as well, and the workpiece is picked up by suction by the sheet. Further, when the picked up workpiece is placed on a platen and the inside of the pressure chamber is made a positive pressure, the valve portions close. Due to this, the pliable sheet deforms molding to the shape of the back surface of the workpiece and the entire back surface of the workpiece is uniformly pressed by the pressure of the fluid in the pressure chamber.

Further, the valve portions are provided with floats which float up in a fluid filled in the pressure chamber to make the valve portions operate to open the holes.

Due to this configuration, when a fluid is filled in the pressure chamber, the floats float up, the valve portions operate to open the holes, and the fluid flows out through the opened holes to automatically release the workpiece from the sheet.

The valve portions need only be configured to close the holes when the inside of the pressure chamber is a negative pressure state and to open the holes when the inside of the pressure chamber is a positive pressure state. Therefore, as one example, according to an aspect of the invention, the valve portions are formed by pliable plate-shaped members with one ends attached to the sheet in a state with the other ends covering the holes of the sheet from the pressure chamber side.

Due to this configuration, when the inside of the pressure chamber is made a negative pressure state, the plate-shaped members move away from the holes of the sheet and open the holes, while when the inside of the pressure chamber is made a positive pressure state, the plate-shaped members press against the sheet and close the holes.

In particular, the pressure chamber sides of the plate-shaped members are provided with floats which float up in a fluid filled in the pressure chamber.

Due to this configuration, when a fluid is filled in the pressure chamber, the floats float up and the plate-shaped members move away from the holes to open the holes. As a result, the fluid flows out from the holes and automatically release the workpiece from the sheet.

Further, the sheet is comprised of n number of sheet members having pliability laminated and adhered to each other; a plurality of valve portions are formed by a plurality of nonadhered portions provided between an x ($1 \leqq x < n$)-th sheet member and an x+1-th sheet member from the pressure chamber side; and the holes are comprised of first through holes passing through the sheet members up to the x-th sheet member and opening to one end part of the nonadhered portions and second through holes communicating with the other end parts of the nonadhered portions and passing through the n-th sheet member from the x+1-th sheet member.

Due to this configuration, when the pressure chamber is made a negative pressure state, the fluid in the second through holes is sucked out from the first through holes to the pressure chamber side through the nonadhered portions and the workpiece is picked up by suction by the n-th sheet member. Further, when the pressure chamber is made a positive pressure, the fluid pressure in the pressure chamber causes the x-th sheet member to press against the x+1-th sheet member and close the nonadhered portions. Further, by filling a fluid in the pressure chamber, the fluid in the pressure chamber will flow out to the wafer W side through the first through holes, the nonadhered portions, and the second through holes and the workpiece will be automatically released.

Note that polishing apparatuses using the carriers according to the aspects of the invention set forth above also stand as aspects of the invention in their own right.

Therefore, according to an aspect of the invention, there is provided a polishing apparatus provided with a rotatable platen, a carrier capable of rotating in a state holding a workpiece on the platen, a fluid supply means able to supply a fluid of a predetermined pressure to the carrier, and a rotation driving means for making the carrier rotate while pressing against it, wherein the carrier comprising: a carrier body having a workpiece holding hole; a pressure chamber defined by a pliable sheet laid in the holding hole of the carrier body and capable of contacting the entire back surface of a workpiece; a fluid passage portion formed by a fluid path provided in the carrier body and communicating with the pressure chamber and by a plurality of holes provided in the sheet and communicating with the pressure chamber; and valve portions provided near the holes of the sheets for closing the holes when the inside of the pressure chamber is a positive pressure in state and opening the holes when the pressure chamber is a negative pressure in state.

Further, the valve portions of the carrier are provided with floats which float up in a fluid filled in the pressure chamber to make the valve portions operate to open the holes.

Further, the valve portions provided at the sheet of the carrier are formed by pliable plate-shaped members with one ends attached to the sheet in a state with the other ends covering the holes of the sheet from the pressure chamber side.

Further, the pressure chamber sides of the plate-shaped members provided at the sheet of the carrier are provided with floats which float up in a fluid filled in the pressure chamber.

Further, the sheet of the carrier is comprised of n number of sheet members having pliability laminated and adhered to each other; a plurality of valve portions are formed by a plurality of nonadhered portions provided between an x ($1 \leqq x < n$)-th sheet member and an x+1-th sheet member from the pressure chamber side; and the holes are comprised of first through holes passing through the sheet members up to the x-th sheet member and opening to one end part of the nonadhered portions and second through holes communicating with the other end parts of the nonadhered portions and passing through the n-th sheet member from the x+1-th sheet member.

BRIEF DESCRIPTION OF THE DRAWINGS

The above and other objects, features, and advantages of the present invention will become more readily apparent from the following description of presently preferred embodiments of the invention taken in conjunction with the accompanying drawings, in which.

DESCRIPTION OF THE PREFERRED EMBODIMENTS

Preferred embodiments of the present invention will be explained below with reference to the drawings.

(First Embodiment)

Figure 1:
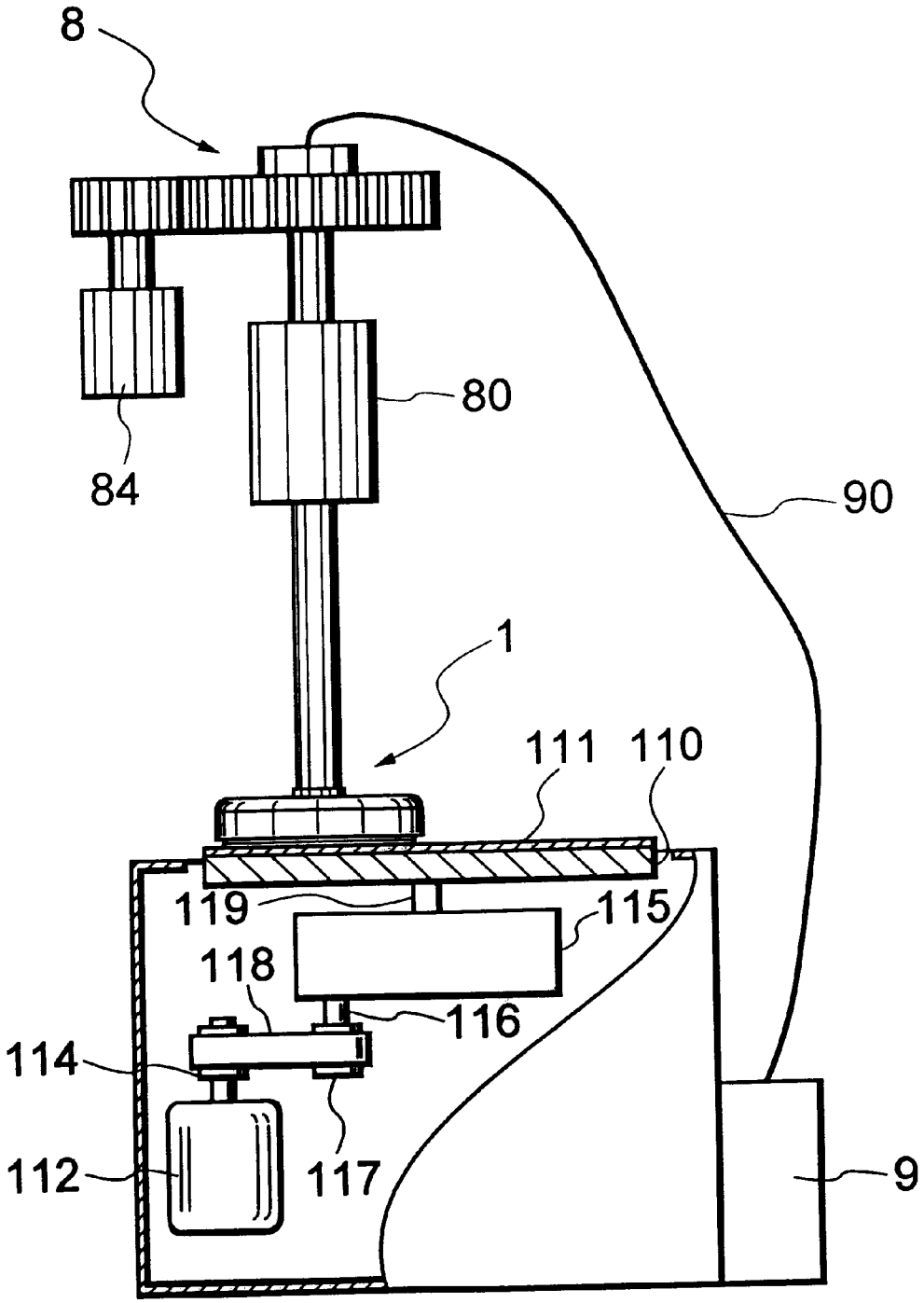
FIG. 1 is a partially cutaway front view of a CMP apparatus according to a first embodiment of the present invention.

FIG. 1 is a partially cutaway front view of a CMP apparatus according to a first embodiment of the present invention.

As shown in FIG. 1, this CMP apparatus is provided with a platen 110 having a polishing pad 111 attached to its surface, a carrier 1, a rotary drive mechanism 8 serving as the rotary drive means, and an air pump 9 serving as a fluid supply means.

The platen 110 is designed to be driven to rotate by a main motor 112 disposed inside the apparatus housing.

That is, a belt 118 is wound around a pulley 114 attached to the main motor 112 and a pulley 117 attached to an input shaft 116 of a transmission 115. The platen 110 is attached to an output shaft 119 of the transmission 115.

Due to this, the rotation of the main motor 112 is transmitted to the pulley 117, the rotation of the pulley 117 is converted in speed by the transmission 115 and transmitted to the output shaft 119, and the platen 110 is rotated at a predetermined speed.

The rotary drive mechanism 8 is a mechanism for making the carrier 1 rotate while pressing against it and is provided with a cylinder 80 and a motor 84.

Figure 2:
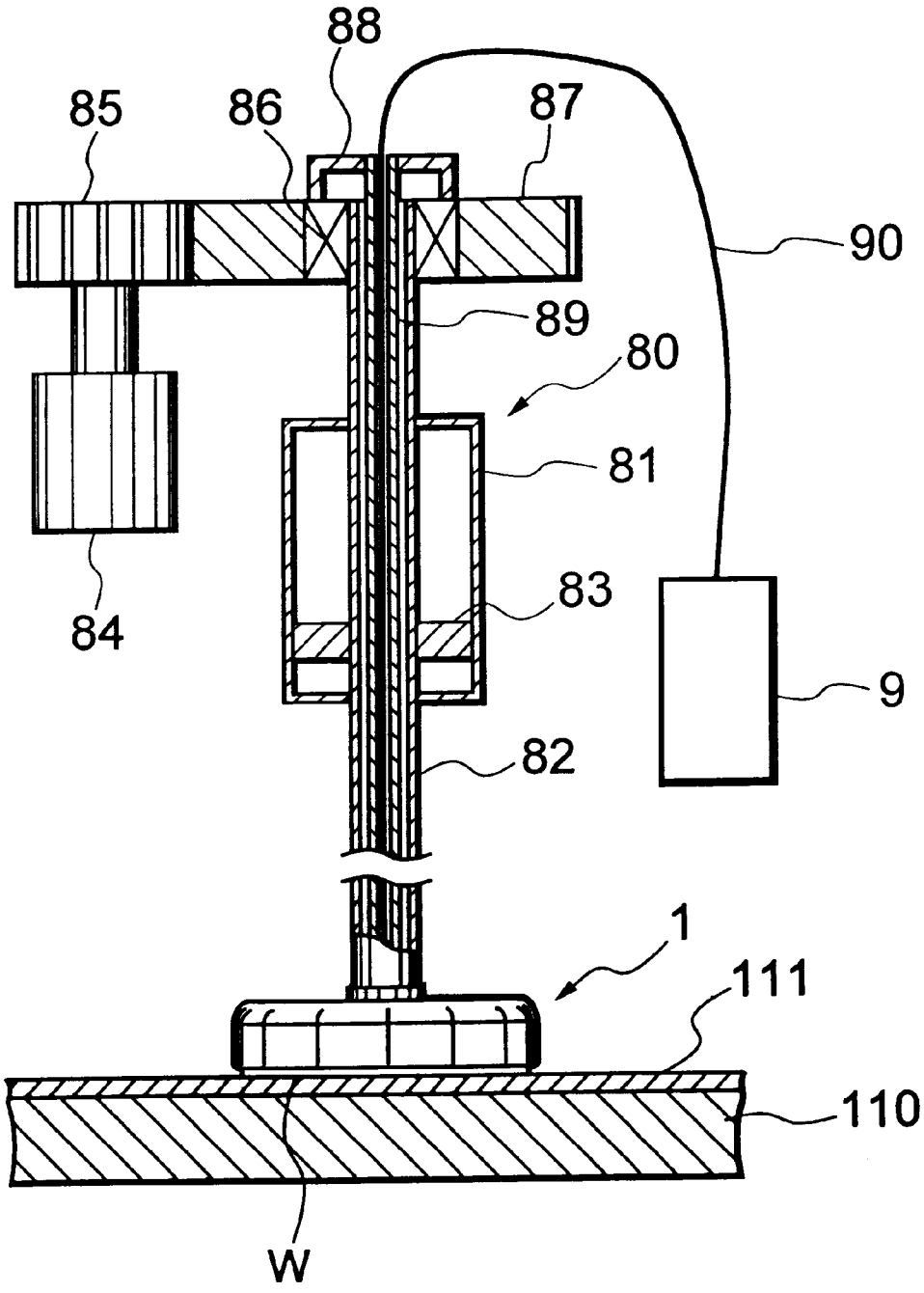
FIG. 2 is a sectional view of the structure of a rotary drive mechanism.

FIG. 2 is a sectional view of the rotary drive mechanism 8.

As shown in FIG. 2, the cylinder 80 is comprised of a piston rod 82 passing through a cylinder body 81 and a piston 83 air-tightly fitting in the cylinder body 81 in a state affixed to the outer side of the piston rod 82.

Due to this, by adjusting the air pressure in the cylinder body 81, it is possible to make the piston rod 82 move up and down integrally with the piston 83 and adjust the pressing force on the carrier 1.

On the other hand, the motor 84 is linked with the piston rod 82 of the cylinder 80. That is, a gear 85 of the shaft of the motor 84 is engaged with a gear 87 attached through a bearing 86 at the upper portion of the piston rod 82. The upper end of the cylindrical inner rod 89 is affixed to a support member 88 affixed to the upper surface of the gear 87.

Due to this, when the motor 84 is driven, the rotation is transmitted to the inner rod 89 through the gears 85 and 87 and the support member 88 and the inner rod 89 rotates at a predetermined speed in the piston rod 82.

The carrier 1 is structured to be able to rotate in a state where the wafer W on the polishing pad 111 of the platen 110 is held and is attached to the lower end portion of the piston rod 82.

Figure 3:
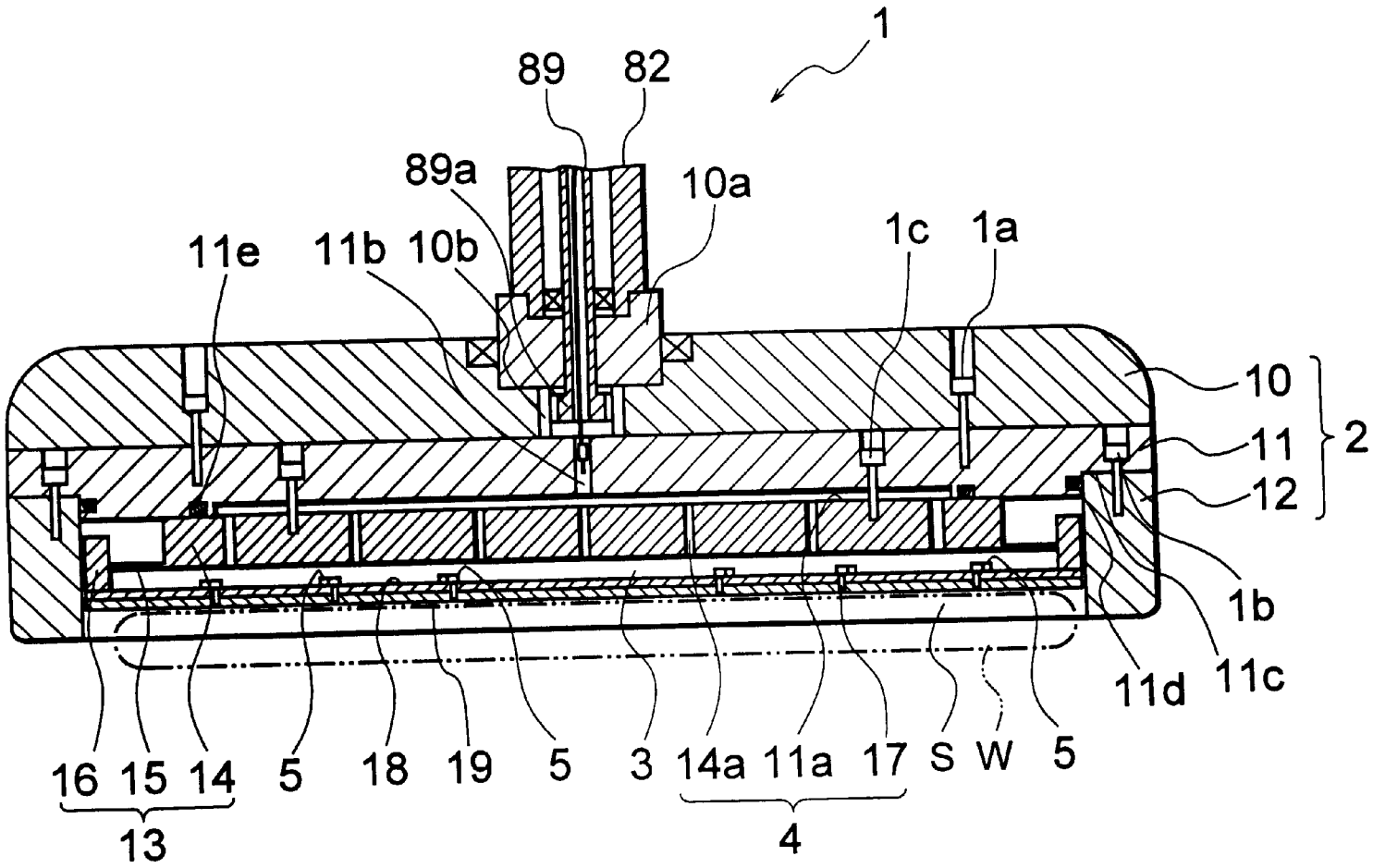
FIG. 3 is a sectional view of the structure of a carrier.

FIG. 3 is a sectional view of the structure of the carrier 1.

The carrier 1 is provided with a carrier body 2, a pressure chamber 3, and a fluid passage portion 4. A plurality of valve portions 5 are specially provided inside the pressure chamber 3.

The carrier body 2 is comprised of a housing 10, a carrier base 11, and a retainer ring 12.

The housing 10 has a rotatable connecting member 10*a* at its center portion. The lower end portion of the piston rod 82 is connected to this connecting member 10*a*. Further, this housing 10 has an internal gear 10*b* at the bottom side of the connecting member 10*a*. The internal gear 10*b* engages with an external gear 89*a* formed at the lower end side of the inner rod 89 passing through a center hole of the connecting member 10*a*.

Due to this, when the inner rod 89 rotates by being driven by the motor 84, the rotational force of the motor 84 is transmitted to the housing 10 by the engagement of the internal gear 10*b* and the external gear 89*a*.

The carrier base 11 is affixed by screws 1*a* to the bottom surface of the housing 10.

The retainer ring 12 is attached to the bottom side of the outer peripheral portion of the carrier base 11.

Specifically, a depression 11*c* of the same width as the retainer ring 12 is cut into the bottom surface of the outer peripheral portion of the carrier base 11. The retainer ring 12 is affixed by screws 1*b* in a state with the top part of the retainer ring 12 fit into the depression 11*c*. An O-ring 11*d* is fit between the retainer ring 12 and the carrier base 11 so as to hold the air-tight state.

Due to this, a wafer holding hole S is defined at the inside of the retainer ring 12.

The pressure chamber 3 is defined by the sheet supporter 13 and the two-layer sheet comprised of the hard sheet 18 and the soft backing sheet 19.

The sheet supporter 13 is affixed by screws 1*c* to the bottom surface of the carrier base 11 in a state arranged in the holding hole S for holding the wafer W.

This sheet supporter 13 is comprised of a supporter body 14 affixed by screws 1*c* to the bottom surface of the carrier base 11, a diaphragm 15 having pliability, and an edge ring 16 formed in a ring shape along the outer edge portion of the diaphragm 15.

The hard sheet 18 and the soft backing sheet 19 are bonded together in the state with the hard sheet 18 at the top. The outer peripheral portion of the upper hard sheet 18 is affixed air-tightly to the bottom surface of the edge ring 16.

Due to this, a pressure chamber 3 is defined between the hard sheet 18 and the sheet supporter 13. When the soft backing sheet 19 contacts the wafer W, the hard sheet 18 and the soft backing sheet 19 flex molding against the warping, undulation, etc. of the wafer W.

The fluid passage portion 4 is comprised of a fluid path formed in the carrier base 11 and sheet supporter 13 and a plurality of holes 17 formed in the hard sheet 18 and the soft backing sheet 19.

Specifically, shallow grooves 11*a* are cut into the bottom surface of the carrier base 11. At the center of the grooves 11*a* is formed an air exit/inlet 11*b* for exit and entry of air of a later mentioned air pump 9. Further, a plurality of air holes 14*a* are formed in the supporter body 14. These air holes 14*a* communicate with the air exit/inlet 11*b* through the grooves 11*a*. In this way, a fluid path communicating with the pressure chamber 3 is comprised by the air holes 14*a*, the grooves 11*a*, and the air exit/inlet 11*b*. Further, an O-ring 11*e* is fit at the outside of the grooves 11*a*, whereby the airtightness between the carrier base 11 and the supporter body 14 is held and air inside the grooves 11*a* is prevented from leaking to the outside.

On the other hand, the holes 17 pass through the hard sheet 18 and the soft backing sheet 19 and communicate with the fluid path through the pressure chamber 3.

The valve portions are portions for opening and closing the holes 17.

Figure 4:
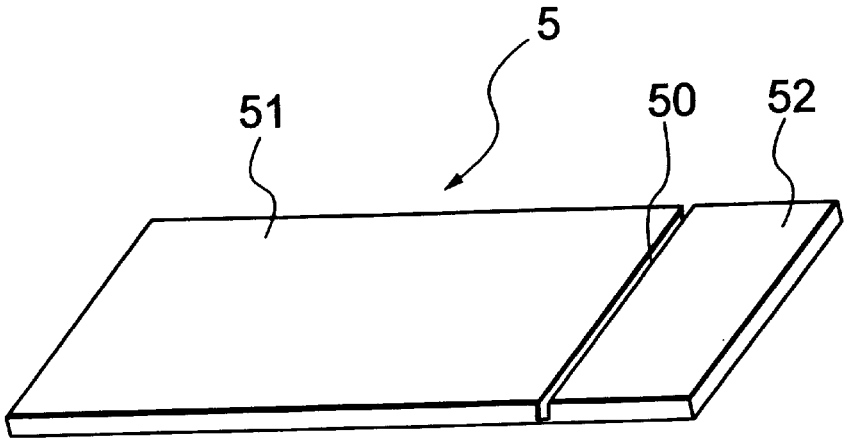
FIG. 4 is a perspective view of a valve portion.
Figure 5:
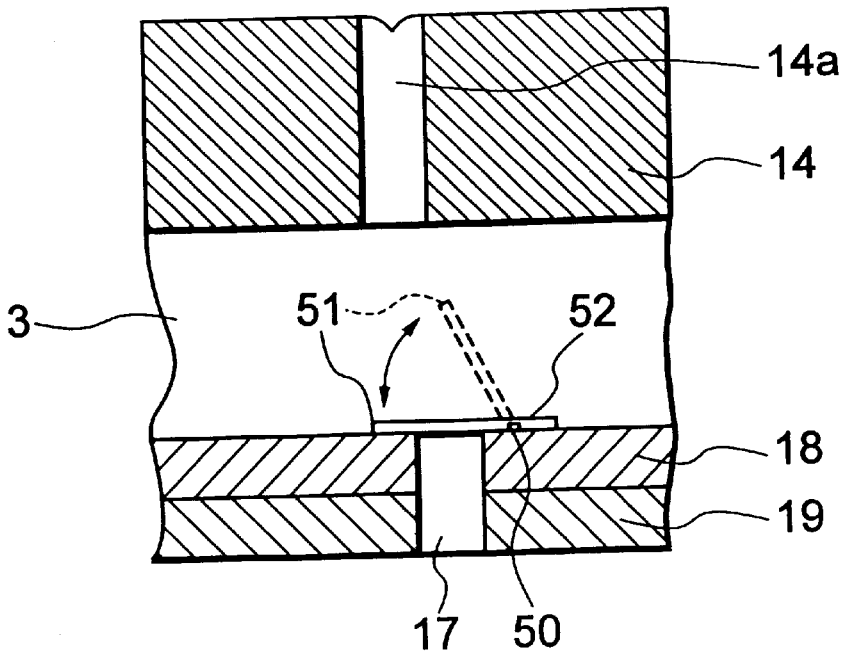
FIG. 5 is a partially enlarged sectional view of the state of attachment of the valve portion.
Figure 6:
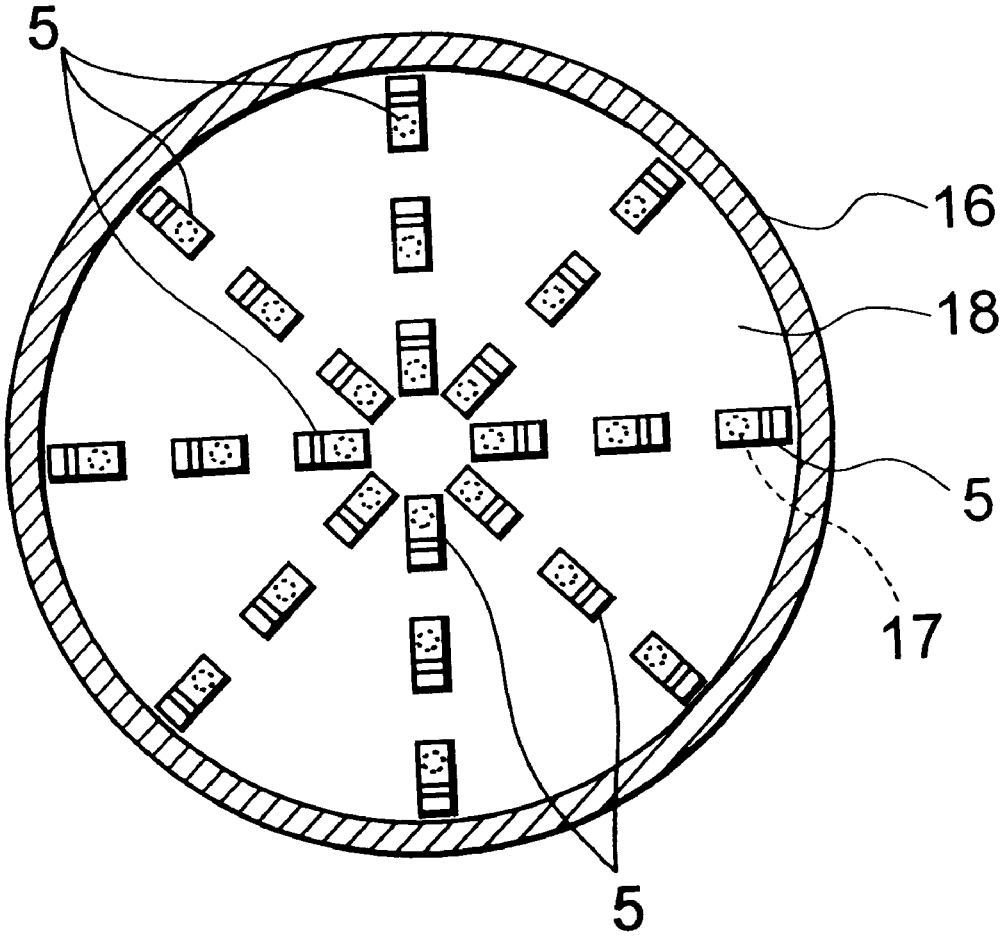
FIG. 6 is a plane view of a plurality of valve portions.

FIG. 4 is a perspective view of a valve portion 5, FIG. 5 is a partially enlarged sectional view showing the state of attachment of a valve portion 5, and FIG. 6 is a plane view of a plurality of valve portions 5.

A valve portion 5, as shown in FIG. 4, is a pliable plate-shaped member formed by a plastic etc. and is provided with a notch 50 across its widthwise direction.

Specifically, the valve portion 5 is divided into an opening/closing portion 51 and an attaching portion 52 by this notch 50. The size of the opening/closing portion 51 is set to be larger than the opening of a hole 17 of the hard sheet 18 and the soft backing sheet 19.

Such a valve portion 5, as shown in FIG. 5 and FIG. 6, is placed on the hard sheet 18 with the notch 50 side down in a state with the opening/closing portion 51 covering the opening of a hole 17. The attaching portion 52 is attached to the hard sheet 18 by an adhesive.

Since the valve portion 5 is provided with the notch 50 and therefore the connecting portion of the opening/closing portion 51 and the attaching portion 52 becomes thinner, when the inside of the pressure chamber 3 becomes a negative pressure state, the opening/closing portion 51 will bend at the notch 50 to open the hole 17 as shown by the broken lines in FIG. 5. Further, when the inside of the pressure chamber 3 becomes a positive pressure, the opening/closing portion 51 will be pressured against the hard sheet 18 to close the hole 17 as shown by the solid lines.

On the other hand, the air pump 9 shown in FIG. 1 and FIG. 2 is a device which supplies air of a desired pressure into the above pressure chamber 3 to make the inside of the pressure chamber 3 a positive pressure or sucks air inside of the pressure chamber 3 out to make the inside of the pressure chamber R a negative pressure. Specifically, an air hose 90 is inserted through the inner rod 89 and as shown in FIG. 3 has a front end portion fit into the air exit/inlet 11*b* of the carrier base 11.

Next, an explanation will be given of the operation of the CMP apparatus of this embodiment.

Figure 7:
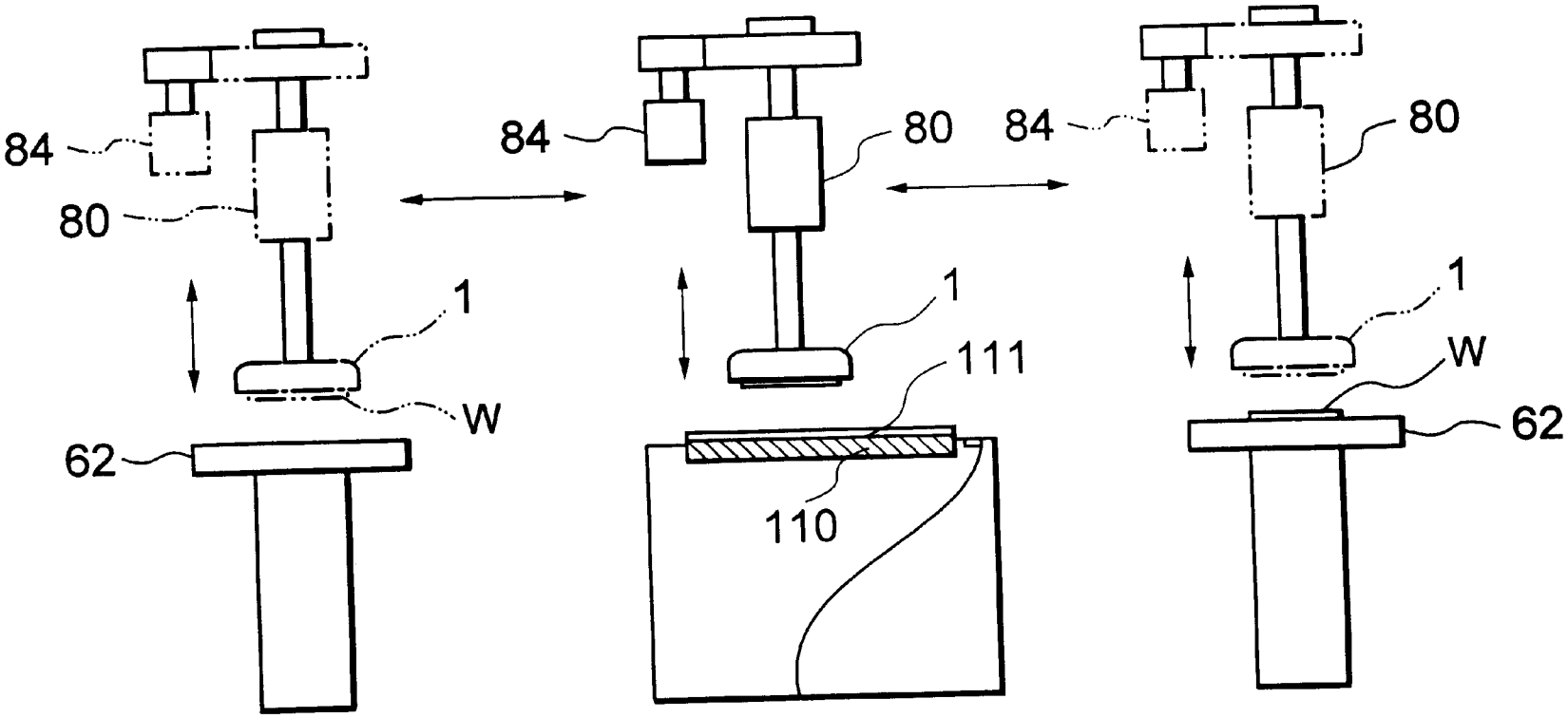
FIG. 7 is a schematic overall view of a polishing system using a CMP apparatus of a first embodiment.

FIG. 7 is a schematic overall view of a polishing system using a CMP apparatus of this embodiment. FIGS. 8A to 8D are views schematically showing a transferring-in step, polishing step, and transferring-out step of the wafer W. Therefore, in FIGS. 8A to 8C, the housing 10, carrier base 11, retainer ring 12, and sheet supporter 13 are omitted and only the carrier body 2, pressure chamber 3, a valve portion 5, hard sheet 18, soft backing sheet 19, a hole 17, and wafer W are shown.

In FIG. 7, when transferring an unpolished wafer W on a transferring-in table 61 to the platen 110 of the CMP apparatus, the overall assembly of the carrier 1, cylinder 80, and motor 84 is moved directly above the transferring-in table 61 as shown by the dot-chain line, then the carrier 1 is made to descend by the cylinder 80.

Figure 8A:
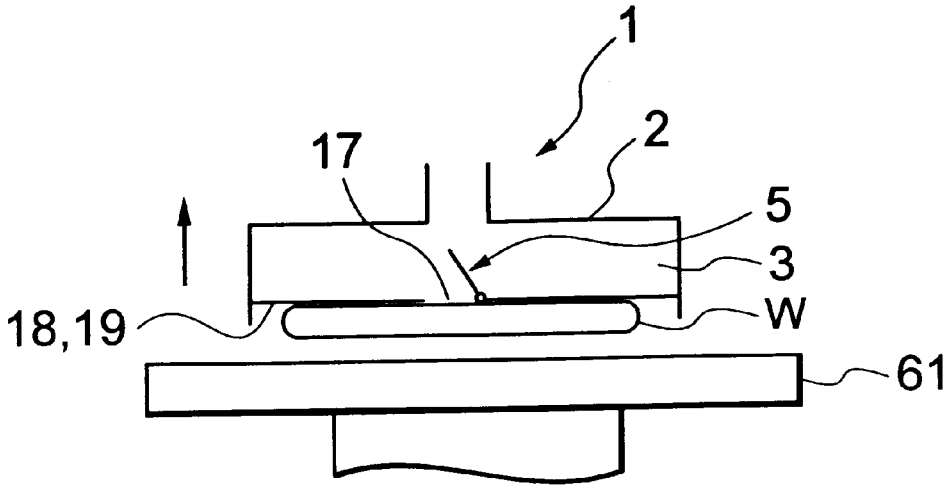
FIGS. 8A to 8D are views showing schematically a transferring-in step, polishing step, and transferring-out step of a wafer.

Next, as shown by FIG. 8A, the air pump 9 shown in FIG. 1 and FIG. 2 is driven to suck air at the point of time when the wafer W contacts the soft backing sheet 19.

Due to this, the pressure chamber 3 becomes a negative pressure state and the opening/closing portion 51 of the valve portion 5 bends to open the hole 17. As a result, air inside the hole 17 is sucked out and the wafer W is sucked against the soft backing sheet 19 through the hole 17.

In this state, the carrier 1 is made to rise by the cylinder 80. The wafer W is transferred directly above the platen 110 of the CMP apparatus, then the carrier 1 is made to descend by the cylinder 80 until the wafer W contacts the polishing pad 111, then the wafer is pressed against the polishing pad 111 by a predetermined pressing force.

Figure 8B:
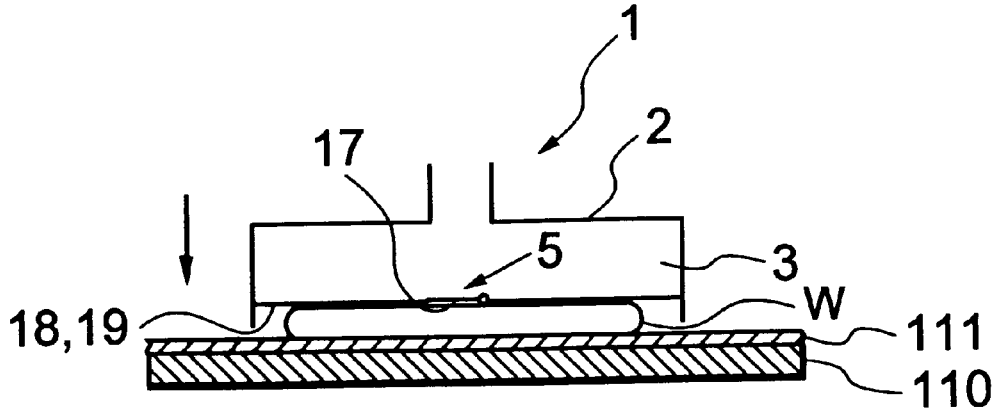
Figure 9:
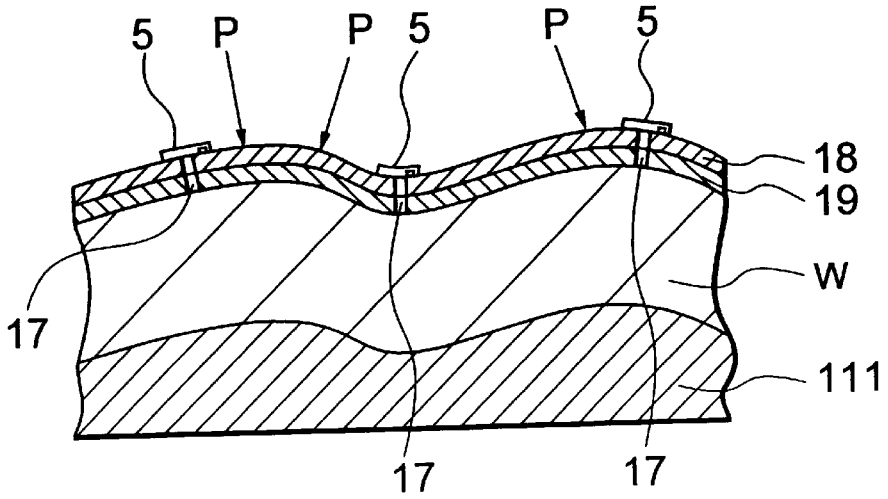
FIG. 9 is a sectional view of the state of the hard sheet and soft backing sheet molding against the unevenness of the wafer.

Suitably thereafter, the air pump 9 is driven to supply air and sends air from the air hose 90 through the fluid path of the fluid passage portion 4 into the pressure chamber 3. This being done, as shown in FIG. 8B, the inside of the pressure chamber 3 becomes a positive pressure in state and the opening/closing portion 51 of the valve portion 5 is pressed against the hard sheet 18 to close the hole 17. As a result, as shown in FIG. 9, the hard sheet 18 and soft backing sheet 19 deform molding against the unevenness of the back surface of the wafer W and a uniform air pressure P is applied to substantially the entire upper surface of the wafer W. In this state, the motors 84 and 112 are driven to make the carrier 1 and the platen 110 rotate while supplying a not shown polishing solution, whereby the surface of the wafer is flattened by a high precision by the polishing pad 111.

At this time, since the hole 17 passing through the hard sheet 18 and the soft backing sheet 19 is closed by the valve portion 5, the compressed air in the pressure chamber 3 will not escape from the hole 17 to the wafer W side. Therefore, there will be no leak contamination of the wafer W and the situation where the polishing solution entering between the retainer ring 12 and the edge ring 16 dries and abrasives stick between the retainer ring 12 and edge ring 16 will not occur.

Figure 8C:
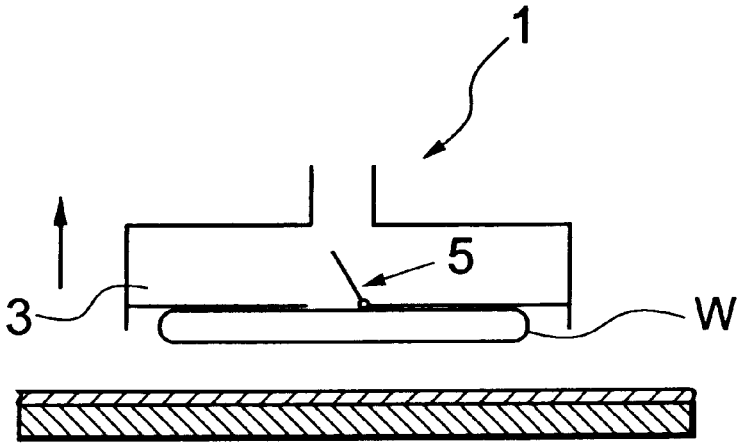

After the above polishing step is completed, as shown in FIG. 8C, the inside of the pressure chamber 3 is made a negative pressure state and the carrier 1 is made to rise while holding the wafer W by suction. As shown by the two-dot chain line in FIG. 7, the entire assembly is then transferred directly above the transferring-out table 62. Suitably thereafter, the carrier 1 is made to descend. The descent of the carrier 1 is stopped at the point of time when the wafer W is positioned very close to the transferring-out table 62.

Figure 8D:
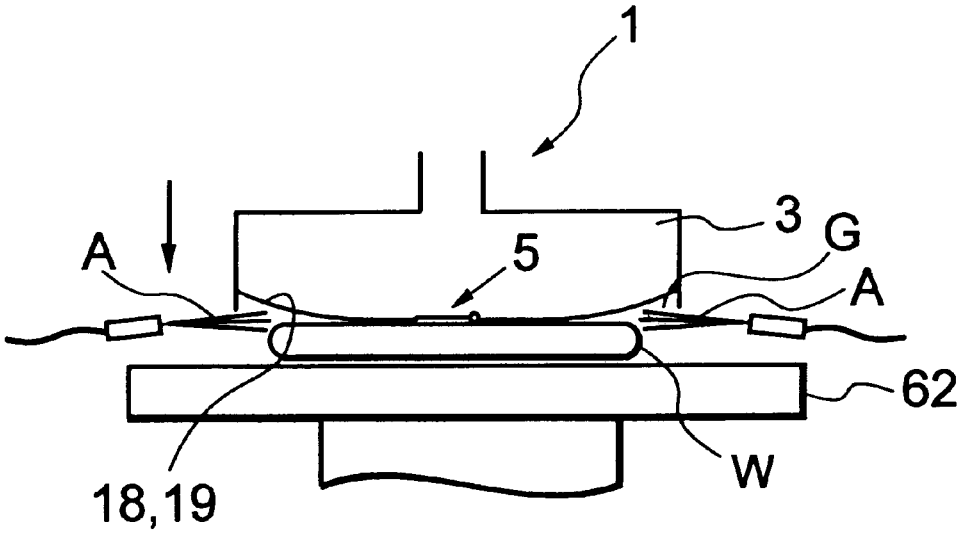

In this state, high pressure air is supplied to the inside of the pressure chamber 3. This being done, since the outer peripheral portion of the hard sheet 18 sticks to the edge ring 16 of the sheet supporter 13, as shown in FIG. 8D, the center portions of the hard sheet 18 and the soft backing sheet 19 bulge out to create a gap G between the soft backing sheet 19 and the back surface.

Next, water A is ejected into the gap G, whereupon the wafer W is released from the soft backing sheet 19 and placed on the transferring-out table 62, whereby the transferring-out step of the wafer W is completed.

(Second Embodiment)

Figure 10:
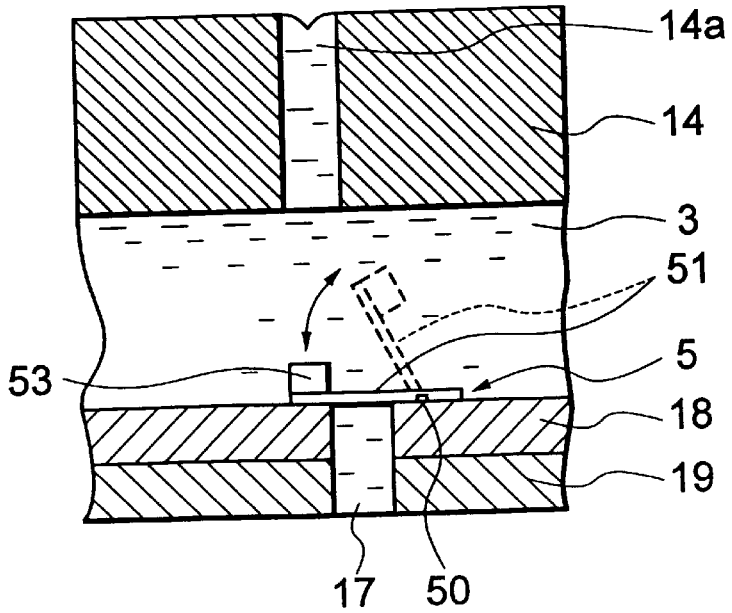
FIG. 10 is a partial enlarged sectional view of the essential portions of a CMP apparatus according to a second embodiment of the present invention.

FIG. 10 is a partially enlarged sectional view of the essential portions of a CMP apparatus according to a second embodiment of the present invention.

This embodiment differs from the above first embodiment in the point that the release operation of the wafer W is automatically performed.

Specifically, as shown in FIG. 10, a float 53 is attached to the upper surface of the opening/closing portion 51 of each of the valve portions 5. This float 53 is formed by a material having a smaller specific gravity than even water, such as polystyrene foam.

Due to this configuration, by placing the inside of the pressure chamber 3 in a negative pressure state or positive pressure state, it is possible to open or close the valve portions 5 to pick up or press the wafer W. Further, in the transferring-out step, by releasing the negative pressure state in the pressure chamber 3 at the point of time when the wafer W is positioned very close to the transferring-out table 62, the valve portions 5 return and close the holes 17. If water is supplied into the pressure chamber 3 in this state, since the floats 53 of the valve portions 5 are lighter than water, they will float up to the supporter body 14 side and, as shown by the broken line in FIG. 10, the opening/closing portions 51 of the valve portions 5 will bend at the notches 50 and open the holes 17. As a result, the water in the pressure chamber 3 will flow out through the holes 17 to the wafer W side and the wafer W will automatically be released from the soft backing sheet 19, whereby the labor involved in the release operation can be saved.

The rest of the configuration and the mode of operation and advantageous effects are similar to those of the first embodiment explained above, so explanations thereof will be omitted.

(Third Embodiment)

Figure 11:
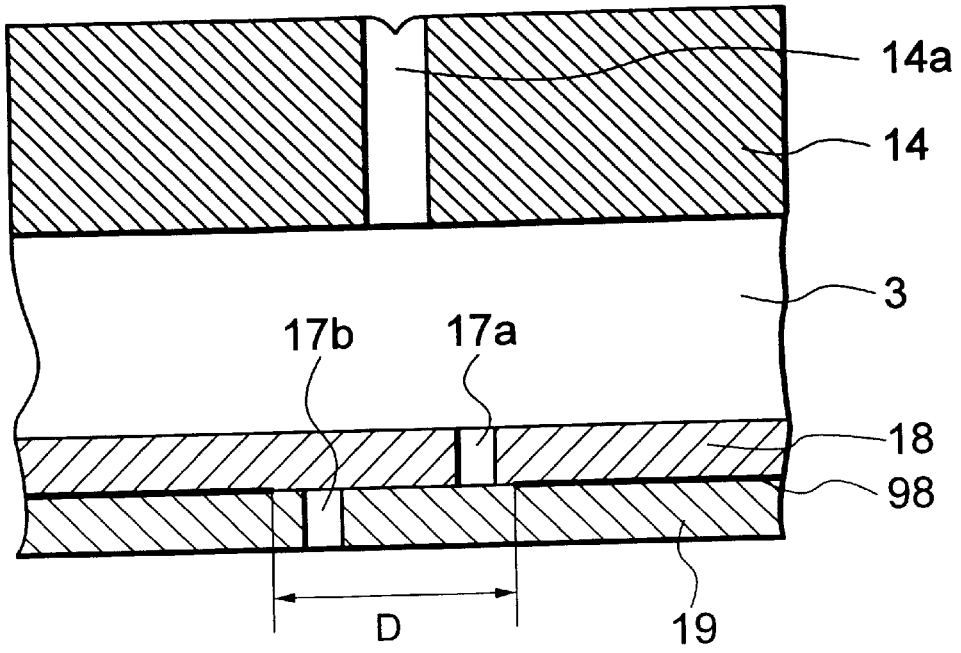
FIG. 11 is a partial enlarged sectional view of the essential portions of a CMP apparatus according to a third embodiment of the present invention.

FIG. 11 is a partially enlarged sectional view of the essential portions of a CMP apparatus according to a third embodiment of the present invention.

This embodiment differs from the first and second embodiments in the point of forming the valve portions utilizing the gap between the hard sheet 18 and the soft backing sheet 19 and without using any special valve portions 5 such as in the first and second embodiments.

That is, the above embodiments were structured with the entire bottom surface of the hard sheet 18 and the entire top surface of the soft backing sheet 19 adhered together by an adhesive. In this embodiment, however, nonadhered portions D with no adhesive 98 are formed between the hard sheet 18 and the soft backing sheet 19.

Figure 12:
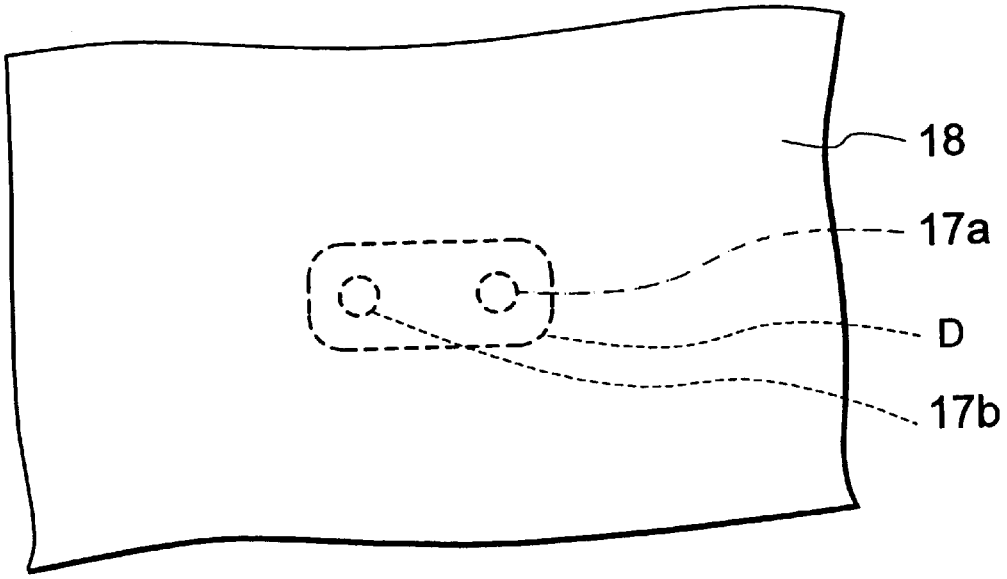
FIG. 12 is a plane view of first and second through holes and nonadhered portions.

Further, holes 17 passing straight through the hard sheet 18 and soft backing sheet 19 like in the above embodiments are not used. Instead, as shown in FIG. 12 as well, provision is made of first through holes 17*a* passing through the hard sheet 18 and communicating with one end part (right end part in FIG. 11 and FIG. 12) of a nonadhered portion D and second through holes 17*b* communicating with the other end part (left end part in FIG. 11 and FIG. 12) of the nonadhered portion D and passing through the soft backing sheet 19.

Figure 13A:
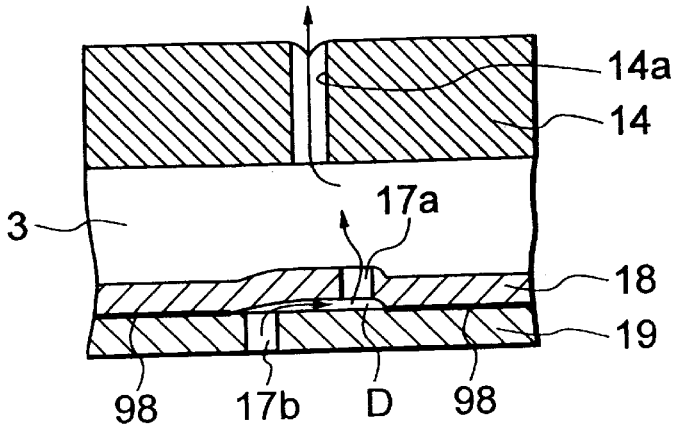
FIGS. 13A to 13C are partially enlarged sectional views showing the operations for picking up, pressing, and releasing the wafer.
Figure 13B:
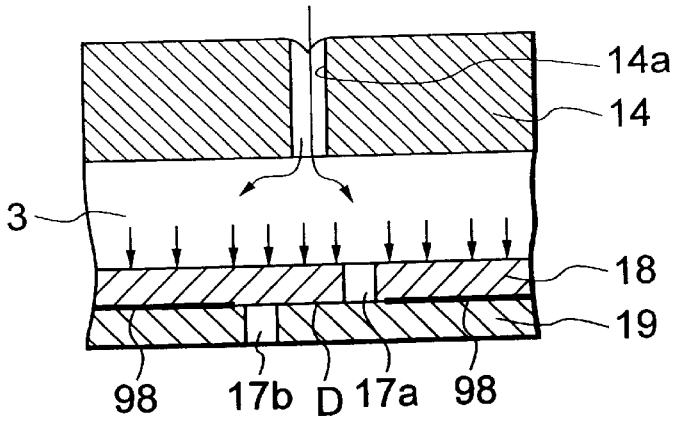
Figure 13C:
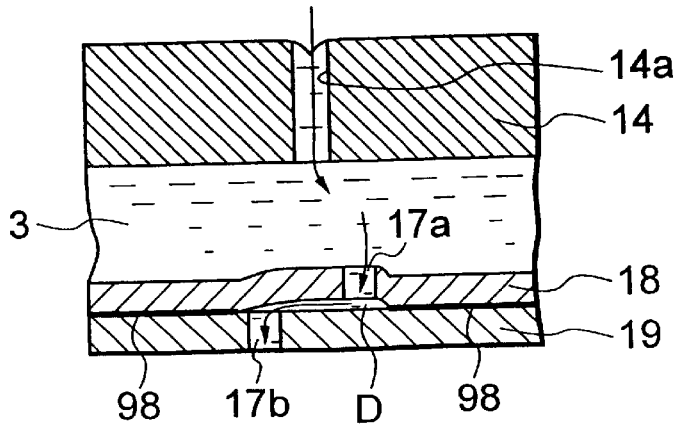

FIGS. 13A to 13C are partially enlarged sectional views showing the operations for picking up, pressing, and releasing a wafer.

When the inside of the pressure chamber 3 is placed in a negative pressure state, as shown by FIG. 13A, the nonadhered portions D open and the air in the second through holes 17*b* is sucked through the nonadhered portions D and the first through holes 17*a* to the pressure chamber 3 side. Due to this, the not shown wafer W is picked up by suction by the second through holes 17*b* in the negative pressure state.

When the wafer W is pressed against the polishing pad 111, then the inside of the pressure chamber 3 is returned to a positive pressure state, as shown in FIG. 13B, the nonadhered portions D are closed by the pressing force in the pressure chamber 3 and the path from the first through holes 17*a* to the second through holes 17*b* are closed. Due to this, the not shown wafer W is uniformly pressed by the air inside the pressure chamber 3.

After the polishing is finished, the same procedure is followed as shown in FIG. 13A to pick up the wafer W by suction then raise it, then water is filled in the pressure chamber 3, whereby, as shown in FIG. 13C, the water in the first through holes 17*a* invades the nonadhered portions D. Due to this, the water in the nonadhered portions D flow out through the second through holes 17*b* to the not shown wafer W side and the wafer W is automatically released.

In this way, according to this embodiment, since the valve portions are formed by the nonadhered portions D of the hard sheet 18 and soft backing sheet 19, it is possible to further reduce the number of parts and the cost of the product.

The rest of the configuration and the mode of operation and advantageous effects are similar to those of the first and second embodiment explained above, so explanations thereof will be omitted.

Note that the present invention is not limited to the above embodiments and include various modifications and changes within the scope of the gist of the invention.

For example, in the above embodiments, air was used as the fluid, but it is also possible to use a fluid such as oil and press uniformly against the wafer W by oil pressure etc.

Figure 14:
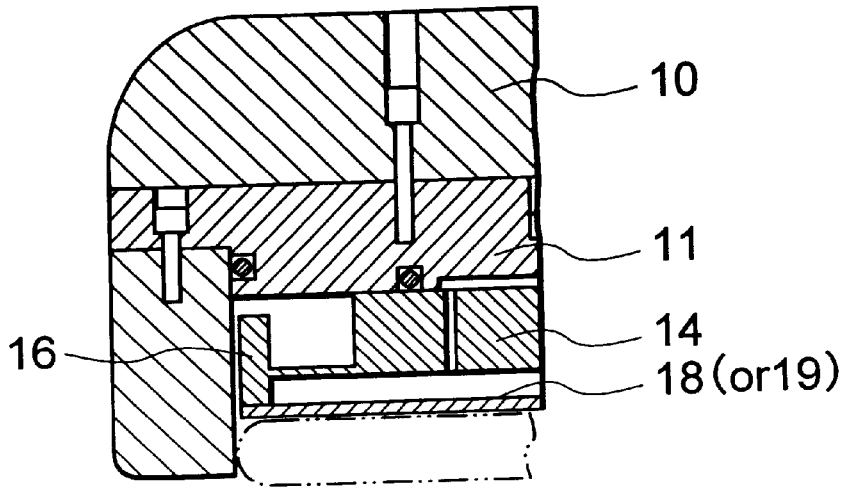
FIG. 14 is a sectional view of a first modification.

Further, in the above embodiments, as the pliable sheet, a double-layer structure sheet comprised of the hard sheet 18 and the soft backing sheet 19 was used, but as shown in FIG. 14, it is also possible to arrange either of the hard sheet 18 or soft backing sheet 19 at the bottom surface of the edge ring 16 and affix the outer peripheral portion of the upper surface of the hard sheet 18 or soft backing sheet 19 air-tightly to the edge ring 16 and attach the valve portions 5 to the upper surface of the hard sheet 18 or soft backing sheet 19.

Figure 15:
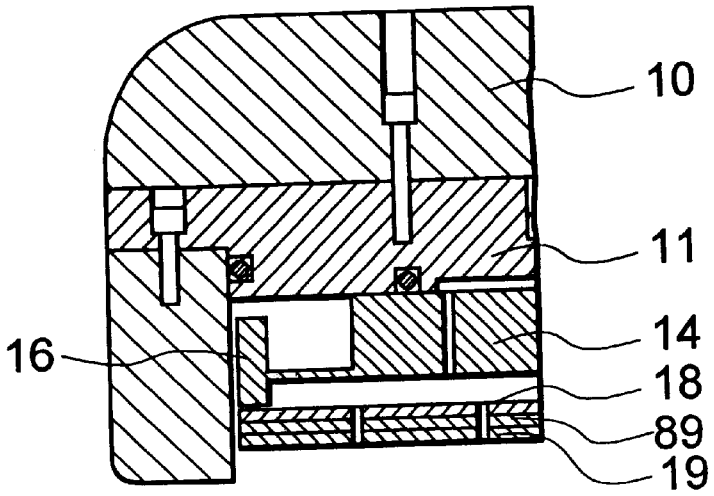
FIG. 15 is a sectional view of a second modification.

Further, as shown in FIG. 15, the hard sheet 18 and the soft backing sheet 19 may be adhered together by an intermediate sheet 89 such as a double-sided adhesive tape and the outer peripheral portion of the upper surface of the hard sheet 18 be affixed air-tightly to the edge ring 16. In this case, it is also possible to provide cutaway portions of the shape shown by the broken lines in FIG. 12 in the intermediate sheet 89 to form the nonadhered portions D shown in the third embodiment.

Figure 18:
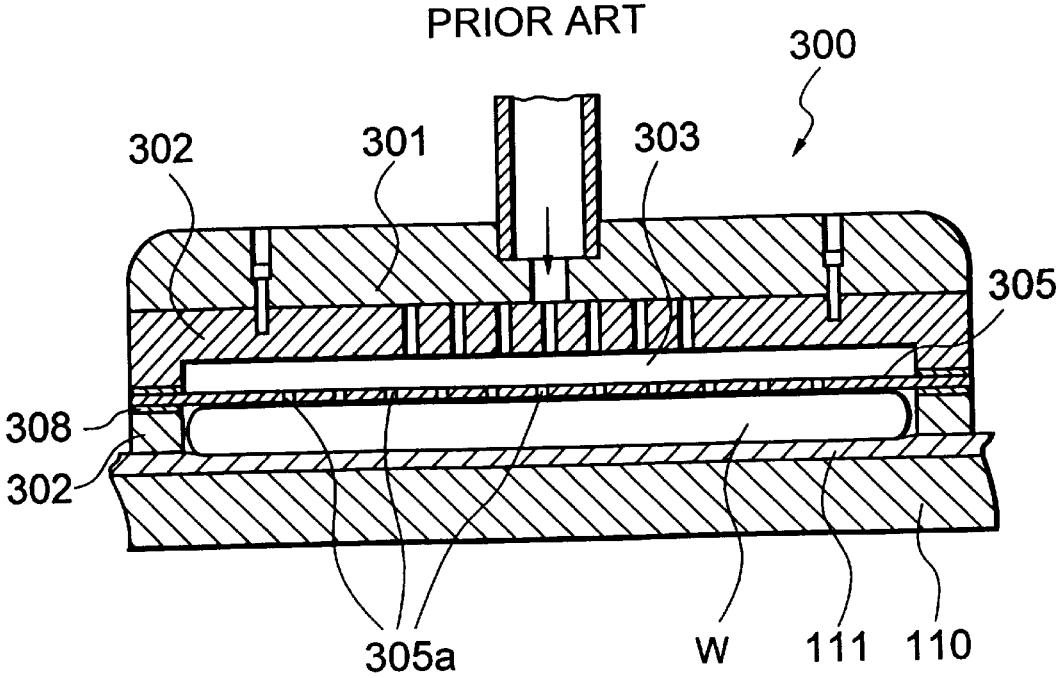
FIG. 18 PRIOR ART
FIG. 18 is a sectional view of a carrier of a second related art.

Further, in the above embodiments, the pressure chamber 3 was defined by the sheet supporter 13, hard sheet 18, and soft backing sheet 19, but it is of course also possible not to use the sheet supporter 13 and, as in the carrier of the related art shown in FIG. 18, attach the hard sheet 18 and the soft backing sheet 19 to the retainer ring 12 to define the pressure chamber 3.

Figure 16:
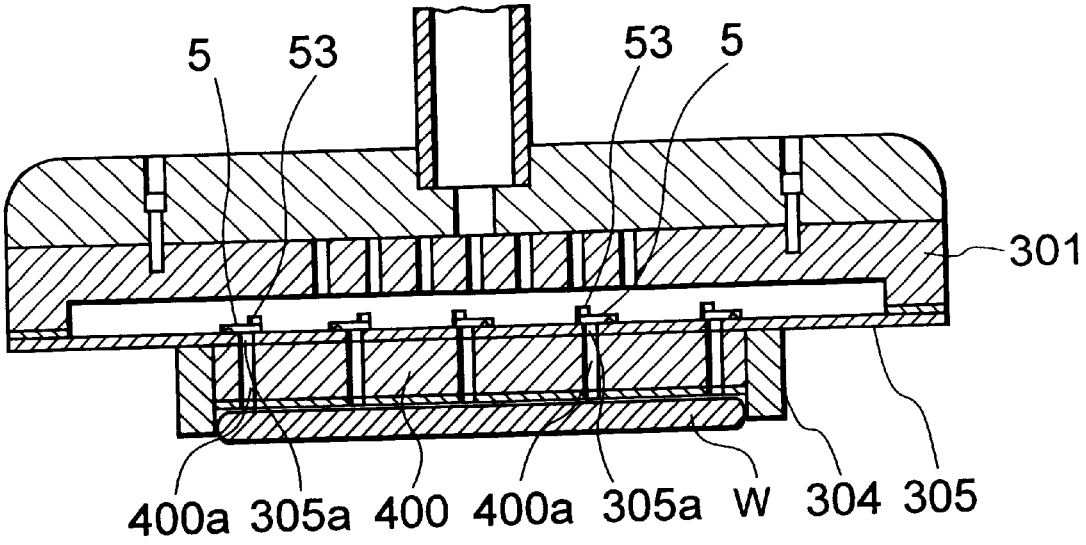
FIG. 16 is a sectional view of a third modification.
Figure 17:
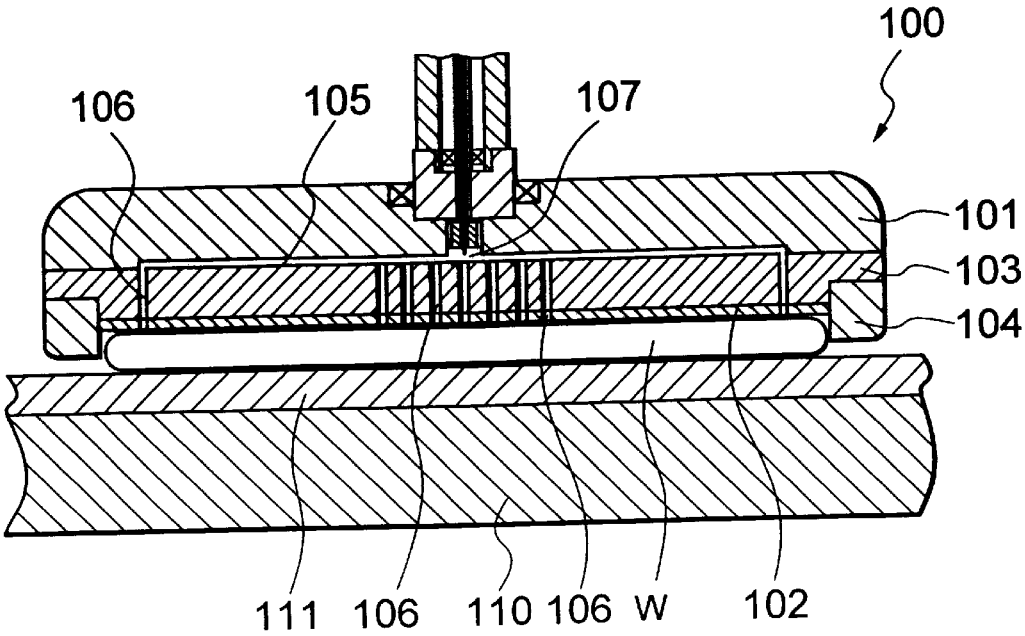
FIG. 17 PRIOR ART
FIG. 17 is a sectional view of the carrier of a first related art.

Further, as a modification of the carrier of the related art shown in FIG. 18, there is one of the structure shown in FIG. 16.

This carrier was structured with a pressure plate 400 having a backing sheet affixed to a film 305 adhered to the outer peripheral portion of the bottom surface of a carrier base 301 and with a retainer ring 304 attached to the outer periphery of this pressure plate 400.

With such a structure of a carrier, however, it is extremely difficult to remove the wafer W from the backing sheet of the pressure plate 400 after polishing.

Accordingly, as shown in this figure, it is possible to structure this to be able to automatically release the wafer W by attaching valve portions 5 with floats 53 to the film 305 and forming holes 400*a* communicating with the holes 305*a* in the pressure plate 400 and backing sheet.

Further, in the first and second embodiments, the valve portions 5 were formed by rectangular plate-shaped members as shown in FIG. 4, but these are not limited to these shapes. They may be made various shapes, such as polyhedrons and disks, so long as they have pliability. Further, the notches 50 need not be provided if the materials are flexible and easy flex.

As explained above in detail, according to the aspects of the invention, since, if the inside of the pressure chamber is made a positive pressure state, the valve portions close, the pliable sheet deforms molding to the shape of the back surface of the workpiece, and the entire back surface of the workpiece is uniformly pressed by the pressure of the fluid in the pressure chamber, it becomes possible to achieve high precision polishing of the surface of the workpiece by making the carrier and platen rotate in that state. Further, at the time of polishing, since the valve portions are closed, there is no leakage of the air or other fluid from the pressure chamber to the workpiece side. Therefore, there is the superior advantageous effect that it is possible to prevent leak contamination of the workpiece or damage to the workpiece due to sticking of abrasives.

Further, according to the aspects of the invention, since the valve portions are formed by pliable plate-shaped members with one ends attached to the sheet in a state with other ends covering the holes of the sheet from the pressure chamber side, the structure of the valve portions becomes simpler and as a result it is possible to reduce the number of parts and the cost of the product.

Further, according to the aspects of the invention, since the workpiece can be automatically released from the sheet, it is possible to save the labor involved in the release operation.

Further, according to the aspects of the invention, the valve portions are formed by nonadhered portions provided between an x-th sheet member and an x+1-th sheet member from the pressure chamber side. Namely, the sheet is comprised of n number of sheet members having pliability laminated and adhered to each other, a plurality of valve portions are formed by a plurality of nonadhered portions provided between an x ($1 \leqq x < n$)-th sheet member and an x+1-th sheet member from the pressure chamber side. The holes are comprised of first through holes passing through the sheet members up to the x-th sheet member and opening to one end part of the nonadhered portions and second through holes communicating with the other end parts of the nonadhered portions and passing through the n-th sheet member from the x+1-th sheet member. Therefore, it is possible to further reduce the number of parts and the cost of the product.

What is claimed is:

1. A carrier comprising:

a carrier body having a workpiece holding hole;

a pressure chamber defined by a pliable sheet laid in the holding hole of said carrier body and capable of contacting an entire back surface of a workpiece;

a fluid passage portion formed by a fluid path provided in said carrier body and communicating with said pressure chamber and by a plurality of holes provided in the sheet and communicating with the pressure chamber; and valve portions provided near the holes of the sheets for closing the holes when the inside of said pressure chamber is a positive pressure in state and opening the holes when said pressure chamber is a negative pressure in state.

2. A carrier as set forth in claim 1, wherein said valve portions are provided with floats which float up in a fluid filled in said pressure chamber to make said valve portions operate to open the holes.

3. A carrier as set forth in claim 1, wherein said valve portions are formed by pliable plate-shaped members with one ends attached to the sheet in a state with the other ends covering the holes of the sheet from the pressure chamber side.

4. A carrier as set forth in claim 3, wherein said pressure chamber sides of the plate-shaped members are provided with floats which float up in a fluid filled in said pressure chamber.

5. A carrier as set forth in claim 1, wherein said sheet is comprised of n number of sheet members having pliability laminated and adhered to each other;

a plurality of valve portions are formed by a plurality of nonadhered portions provided between an x ($1 \leqq x < n$)-th sheet member and an x+1-th sheet member from said pressure chamber side; and the holes are comprised of first through holes passing through the sheet members up to a x-th sheet member and opening to one end part of the nonadhered portions and second through holes communicating with the other end parts of the nonadhered portions and passing through a n-th sheet member from the x+1-th sheet member.

6. A polishing apparatus provided with a rotatable platen, a carrier capable of rotating in a state holding a workpiece on the platen, a fluid supply means capable of supplying a fluid of a predetermined pressure to the carrier, and a rotation driving means for making the carrier rotate while pressing against said carrier, said carrier comprising:

a carrier body having a workpiece holding hole; a pressure chamber defined by a pliable sheet laid in the holding hole of said carrier body and capable of contacting an entire back surface of a workpiece; a fluid passage portion formed by a fluid path provided in said carrier body and communicating with the pressure chamber and by a plurality of holes provided in the sheet and communicating with said pressure chamber; and valve portions provided near the holes of the sheets for closing the holes when the inside of the pressure chamber is a positive pressure in state and opening the holes when said pressure chamber is a negative pressure in state.

7. A polishing apparatus as set forth in claim 6, wherein said valve portions of the carrier are provided with floats which float up in a fluid filled in said pressure chamber to make the valve portions operate to open the holes.

8. A polishing apparatus as set forth in claim 6, wherein said valve portions provided at the sheet of said carrier are formed by pliable plate-shaped members with one ends attached to the sheet in a state with the other ends covering the holes of the sheet from the pressure chamber side.

9. A polishing apparatus as set forth in claim 8, wherein the pressure chamber sides of the plate-shaped members provided at the sheet of said carrier are provided with floats which float up in a fluid filled in the pressure chamber.

10. A polishing apparatus as set forth in claim 6, wherein said sheet of said carrier is comprised of n number of sheet members having pliability laminated and adhered to each other;

a plurality of valve portions are formed by a plurality of nonadhered portions provided between an x ($1 \leqq x < n$)-th sheet member and an x+1-th sheet member from said pressure chamber side; and the holes are comprised of first through holes passing through the sheet members up to a x-th sheet member and opening to one end part of the nonadhered portions and second through holes communicating with the other end parts of the nonadhered portions and passing through a n-th sheet member from the x+1-th sheet member .

* * * * *